US012668403B2

(12) United States Patent
Gu

(10) Patent No.: US 12,668,403 B2
(45) Date of Patent: Jun. 30, 2026

(54) AIRTIGHT COVER AND AIRTIGHT CONTAINER

(71) Applicant: WITHCLEAN CO., LTD., Goyang-si (KR)

(72) Inventor: Hyunwoo Gu, Seoul (KR)

(73) Assignee: WITHCLEAN CO., LTD., Goyang-si (KR)

( * ) Notice: Subject to any disclaimer, the term of this patent is extended or adjusted under 35 U.S.C. 154(b) by 0 days.

(21) Appl. No.: 18/871,109

(22) PCT Filed: Apr. 19, 2023

(86) PCT No.: PCT/KR2023/005269

§ 371 (c)(1),
(2) Date: Dec. 2, 2024

(87) PCT Pub. No.: WO2023/214715

PCT Pub. Date: Nov. 9, 2023

(65) Prior Publication Data

US 2025/0229951 A1 Jul. 17, 2025

(30) Foreign Application Priority Data

May 3, 2022 (KR) ..... 10-2022-0054509

(51) Int. Cl.
*B65D 43/02* (2006.01)
*B65D 45/24* (2006.01)

(52) U.S. Cl.
CPC ..... *B65D 43/0212* (2013.01); *B65D 45/24* (2013.01); *B65D 2543/00092* (2013.01); *B65D 2543/00805* (2013.01)

(58) Field of Classification Search
CPC ..... B65D 45/24; B65D 2543/00092; B65D 2543/00805; B65D 2543/0087; B65D 43/0212; B65D 2543/00814
(Continued)

(56) References Cited

U.S. PATENT DOCUMENTS 5,147,059 A * 9/1992 Olsen ..... B65D 43/0212 220/793
8,870,021 B2 * 10/2014 Smyers ..... A47G 19/02 220/795
2019/0047753 A1 * 2/2019 Koo ..... B65D 43/0212

FOREIGN PATENT DOCUMENTS

EP 2982613 A1 * 2/2016 ..... B65D 85/36
JP H10-218209 A 8/1998
(Continued)

OTHER PUBLICATIONS

Takei, Hideyuki Sato, "Office Action for Japanese Application No. 2024-564654", dated Aug. 19, 2025, JPO, Japan.

*Primary Examiner* — Orlando E Aviles
*Assistant Examiner* — Sanjidul Islam
(74) *Attorney, Agent, or Firm* — Bridgeway IP Law Group, PLLC; Jihun Kim

(57) ABSTRACT

According to one embodiment, an airtight container includes a container body having an opening and an airtight cover separably coupled to the opening of the container body, wherein the airtight cover includes a cover body for covering the opening, a hinge base extended outward from the cover body, a flap connected to be rotatable, relative to the hinge base, by means of a bent part provided at one side thereof and a support protrusion which is extended in the direction oriented toward the cover body from one side of the flap.

13 Claims, 7 Drawing Sheets

(58) Field of Classification Search
USPC ..... 220/780
See application file for complete search history.

(56) References Cited

FOREIGN PATENT DOCUMENTS

| | | | |
|---|---|---|---|
| JP | 2001-219953 | A | 8/2001 |
| JP | 2012-012071 | A | 1/2012 |
| KR | 10-2009-0038489 | A | 4/2009 |
| KR | 10-2019-0113689 | A | 10/2019 |
| KR | 10-2021-0029634 | A | 3/2021 |
| KR | 10-2022-0051833 | A | 4/2022 |
| KR | 10-2022-0065726 | A | 5/2022 |
| WO | 2008/018546 | A | 2/2008 |

* cited by examiner

AIRTIGHT COVER AND AIRTIGHT CONTAINER

CROSS-REFERENCE TO RELATED APPLICATIONS

This application is a National Phase Application of PCT International Application No. PCT/KR2023/005269, which was filed on Apr. 19, 2023, and which claims priority from Korean Patent Application No. 10-2022-0054509 filed with the Korean Intellectual Property Office on May 3, 2022. The disclosures of the above patent applications are incorporated herein by reference in their entirety.

TECHNICAL FIELD

The present invention relates to an airtight container, more particularly to an airtight cover and an airtight container that are easy to manufacture, convenient to use, and easy to open.

BACKGROUND ART

Airtight containers are often used to store foodstuffs hygienically for increased periods. A frequently used airtight container has one or more protrusions formed on the container body and one or more locking wings formed on the cover, with hooks formed on the locking wings to engage the protrusions. With such a container, the user can close the container by rotating the locking wings of the cover downward, such that the hooks of the locking wings engage the protrusions, and can open the container by rotating the locking wings of the cover upward, such that the hooks of the locking wings are disengaged from the protrusions.

Such a container requires that the protrusions be formed on the container body so that the protrusions may be securely engaged with the hooks of the locking wings, and in order that the cover may be coupled to the container body regardless of orientation, the protrusions are either formed along the entire upper portion of the container body or on the respective four sides of the container body. That is, the cover suffers from low utility, since the cover cannot be used properly unless it is used together with a container body that was manufactured to include the protrusions.

Also, the portions protruding from the surfaces of the container body can be difficult to clean. That is, the top and bottom of a protrusion form acute nooks with respect to the container body, and it can require special care to clean these portions. In cases where the airtight container is used for storing a foodstuff, this can create problems in hygiene, as the protrusions are formed around the opening at the upper portion of the container body and thus require cleanliness the most but in fact cause the level of cleanliness to decline especially at this portion. Moreover, the protrusions of the container body make it difficult to store and carry the container and also can be bothersome during use, as the protrusions may bump into the cover and locking wings, etc., even after the hooks of the cover have been separated.

As regards the manufacturing aspect, an airtight container using locking wings requires accurate engagements between the hooks of the locking wings and the protrusions of the container body and therefore requires a manufacturing system of a relatively high level of precision. Considering that typical storage containers are fabricated from materials such as glass, ceramic, stainless steel, etc., and that manufacturing tolerances with these materials can be as high as +/−2 mm, manufacturing the airtight container with conventional technology inevitably entails a high probability in the occurrence of defects where the hooks cannot properly engage the protrusions.

DETAILED DESCRIPTION OF THE INVENTION

Technical Problem

An aspect of the present invention, which was conceived to resolve the problem described above, is to provide an airtight cover and an airtight container that are easy to manufacture, convenient to use, and easy to open, as the airtight cover can be used with a container body that does not have protrusions.

Other objectives of the present invention will be more clearly understood from the embodiments set forth below.

Technical Solution

An airtight container according to one aspect of the invention can include a container body in which an opening is formed and an airtight cover that is separably coupled to the opening of the container body. Here, the airtight cover can include: a cover body configured to cover the opening; a hinge base extending outward from the cover body; a flap rotatably connected to the hinge base by a fold part formed on one side thereof; and a support protrusion extending from the one side of the flap in a direction heading towards the cover body, where a contact part configured to contact the container body can be formed on an end portion of the support protrusion. When the flap is rotated downward with respect to the hinge base, the airtight cover can be coupled to the container body, as a contact support surface of the contact part presses against the container body. For a reference line defined as an imaginary line running from the center of the cover body along a horizontal direction towards the center of the contact support surface, and for a pressure point defined as the point at which the container body applies a normal force in an outward direction onto the contact support surface, the fold part can be located under the pressure point and can be located further outward compared to the pressure point along the reference line when the airtight cover is in a coupled state with respect to the container body.

An airtight container according to another aspect of the invention can also include a container body in which an opening is formed and an airtight cover that is separably coupled to the opening of the container body. The airtight cover can include: a cover body configured to cover the opening; a hinge base extending outward from the cover body; a flap rotatably connected to the hinge base by a fold part formed on one side thereof; and a support protrusion extending from the one side of the flap in a direction heading towards the cover body, where a contact part configured to contact the container body can be formed on an end portion of the support protrusion. When the flap is rotated downward with respect to the hinge base, the airtight cover can be coupled to the container body, as a contact support surface of the contact part presses against the container body. For a reference line defined as an imaginary line running from the center of the cover body along a horizontal direction towards the center of the contact support surface, and for a pressure point defined as the point at which the container body applies a normal force in an outward and downward direction onto the contact support surface, the fold part can be located further inward compared to the pressure point along the reference line when the airtight cover is in a coupled state with respect to the container body.

An airtight container according to an embodiment of the present invention can include one or more of the following features. For example, the container body can include a body rim that is formed such that the outer diameter at a first point is greater than the outer diameter at a second point located lower than the first point, and the contact support surface can contact the first point and the second point when the airtight cover is in a coupled state with respect to the container body.

When the flap reaches a particular angle while the flap is being rotated downward with respect to the hinge base, an end portion of the contact part can contact the container body, and when a greater force is applied on the flap, the contact part can pass over, as at least one of the contact part, the support protrusion, and the fold part undergoes elastic deformation.

The container body can be fabricated by blow molding such that a portion of the container body under the body rim has an outer diameter greater than that of the first point.

The airtight cover can further include a cover rim that extends downward from an edge of the cover body, and the hinge base can extend outward from a designated position on an exterior surface formed by the cover body and the cover rim.

The flap can be connected to a pair of hinge bases by a pair of fold parts, the support protrusion can extend in the direction heading towards the cover body from a position between the pair of fold parts, and a clearance recess can be formed in the cover rim at a position corresponding to a space between the pair of hinge bases such that the support protrusion passes through the clearance recess when the flap is rotated.

The airtight cover can further include a hook protrusion that extends inward from a lower portion of the cover rim. In cases where the container body includes a body rim that is formed such that the outer diameter at a first point is greater than the outer diameter at a second point located lower than the first point, the hook protrusion can include an inclined surface that is configured to contact the first point and the second point when the airtight cover is in a coupled state with respect to the container body.

The container body can have a cross section corresponding to any one of a circle, a polygon, and a combination of one or more circles and one or more polygons.

The airtight cover can include a multiple number of flaps.

At least a portion of the contact support surface, the contact part, and the support protrusion can be replaceably coupled with the flap. In such cases, at least one of the contact support surface, the contact part, and the support protrusion can have a lower elastic modulus than that of the flap.

Still another aspect of the invention can provide an airtight cover that is separably coupled to the opening of a container body. Such an airtight cover can include: a cover body configured to cover the opening; a hinge base extending outward from the cover body; a flap rotatably connected to the hinge base by a fold part formed on one side thereof; and a support protrusion extending from the one side of the flap in a direction heading towards the cover body, where a contact part configured to contact the container body can be formed on an end portion of the support protrusion. When the flap is rotated downward with respect to the hinge base, the airtight cover can be coupled to the container body, as a contact support surface of the contact part presses against the container body. For a reference line defined as an imaginary line running from the center of the cover body along a horizontal direction towards the center of the contact support surface, and for a pressure point defined as the point at which the container body applies a normal force in an outward direction onto the contact support surface, the fold part can be located under the pressure point and can be located further outward compared to the pressure point along the reference line when the airtight cover is in a coupled state with respect to the container body.

Yet another aspect of the invention can provide an airtight cover that is separably coupled to the opening of a container body. Such an airtight cover can include: a cover body configured to cover the opening; a hinge base extending outward from the cover body; a flap rotatably connected to the hinge base by a fold part formed on one side thereof; and a support protrusion extending from the one side of the flap in a direction heading towards the cover body, where a contact part configured to contact the container body can be formed on an end portion of the support protrusion. When the flap is rotated downward with respect to the hinge base, the airtight cover can be coupled to the container body, as a contact support surface of the contact part presses against the container body. For a reference line defined as an imaginary line running from the center of the cover body along a horizontal direction towards the center of the contact support surface, and for a pressure point defined as the point at which the container body applies a normal force in an outward and downward direction onto the contact support surface, the fold part can be located further inward compared to the pressure point along the reference line when the airtight cover is in a coupled state with respect to the container body.

Advantageous Effects

An embodiment of the present invention having the features above can provide various advantageous effects including the following. However, an embodiment of the present invention may not necessarily exhibit all of the effects below.

An airtight cover and an airtight container according to an embodiment of the present invention can seal a container body, even if there are no protrusions formed on the container body. This makes it easier to manufacture the airtight cover and airtight container and also allows the user to use and open the airtight container more easily.

MODE FOR CARRYING OUT THE INVENTION

Figure 1:
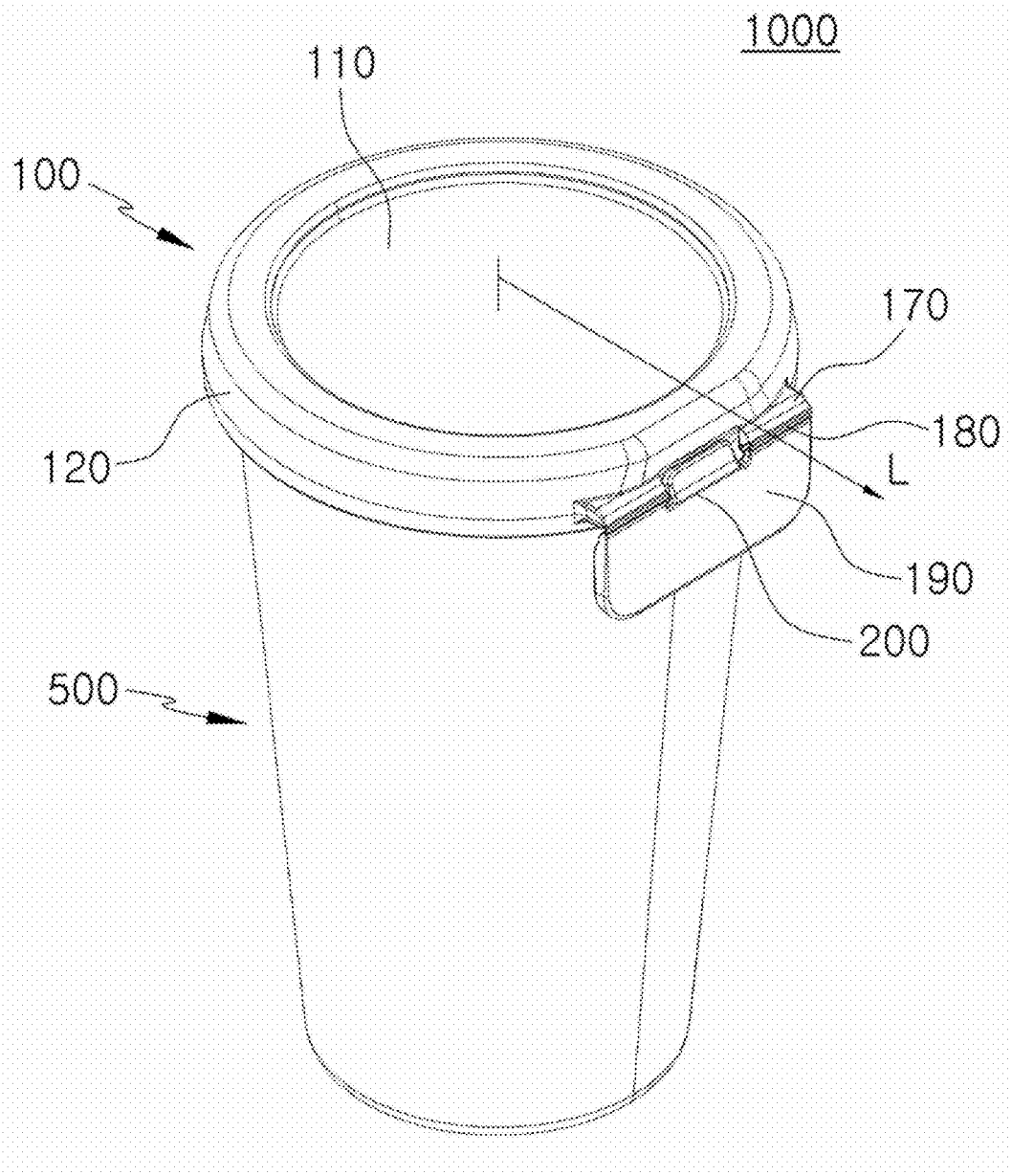
FIG. 1 is a perspective view illustrating an airtight container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2:
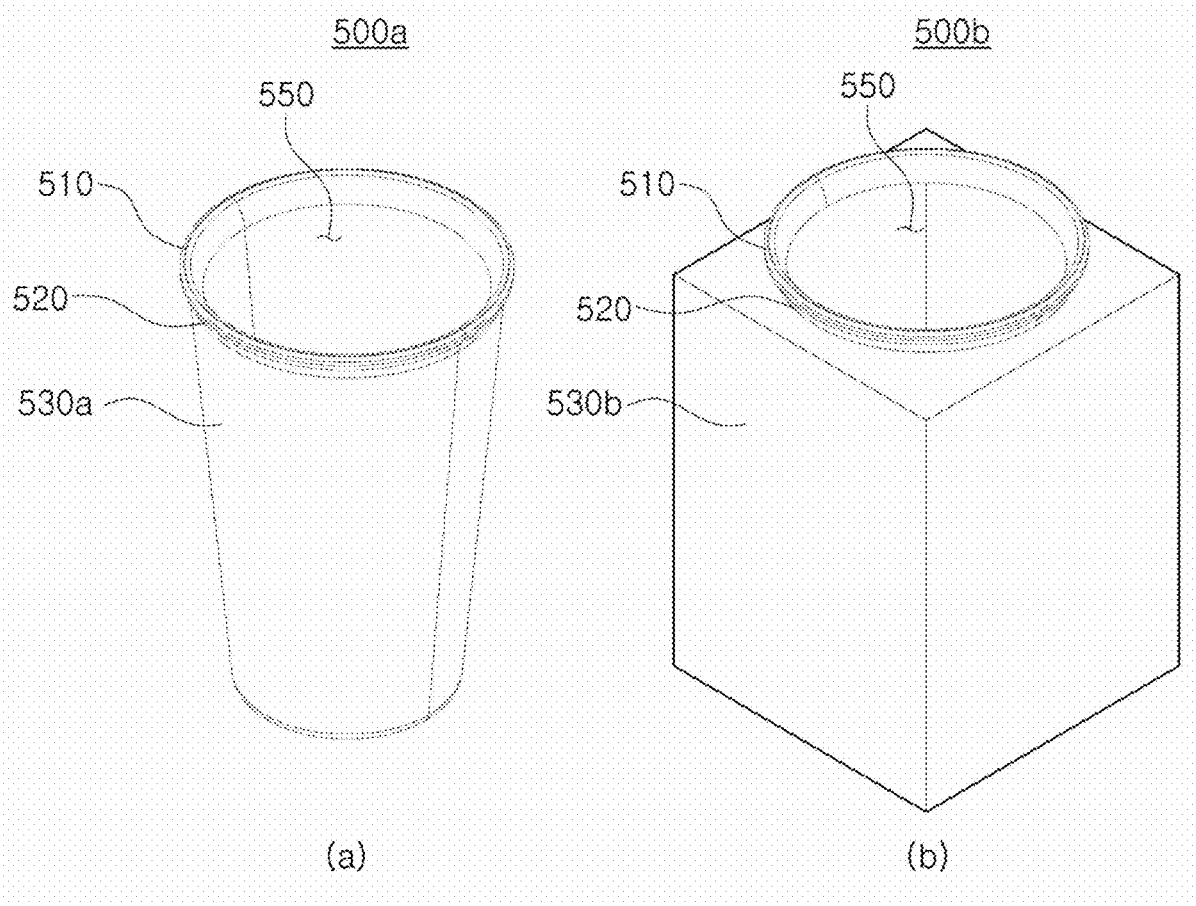
FIG. 2 is a perspective view of the container bodies for an airtight container according to an embodiment of the invention as seen from above.

FIG. 1 is a perspective view illustrating an airtight container 1000 according to an embodiment of the invention. FIG. 2 is a perspective view of the container bodies 500*a*, 500*b* as seen from above, and FIG. 3 is a perspective view illustrating an airtight cover 100 as seen from below.

Figure 3:
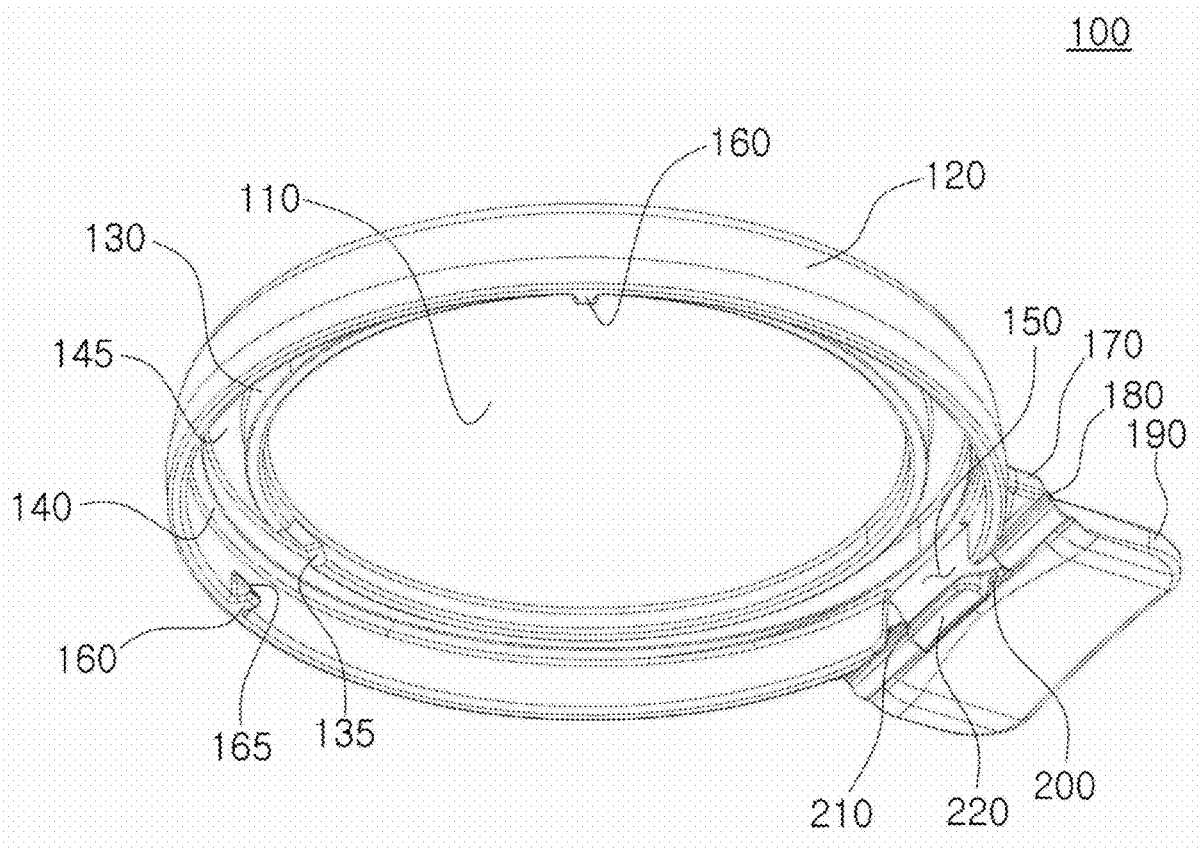
FIG. 3 is a perspective view illustrating an airtight cover according to an embodiment of the invention as seen from below.

Referring to FIGS. 1 to 3, an airtight container 1000 according to an embodiment of the invention can include an airtight cover 100 and a container body 500, where the airtight cover 100 can be separably coupled to the opening 550 of the container body 500 to seal the interior of the container body 500.

Referring first to FIG. 2, the container body 500 can form an interior space, and the interior space can be accessible through an opening 550 formed at the top. For the sake of convenience, the portion of the container body 500 surrounding the opening 550 is referred to herein as the body rim 510, and the outer diameter at the portion of the body rim 510 where the outer diameter is the greatest is referred to herein as the first outer diameter.

In the container body 500*a* illustrated in FIG. 2(*a*), a second diameter part 520 having a second outer diameter that is smaller than the first outer diameter is formed below the body rim 510, and the third diameter part 530*a* under the second diameter part 520 has an outer diameter that is smaller than the second outer diameter.

In contrast, in FIG. 2(*b*), the illustrated container body 500*b* has an identical body rim 510 and an identical second diameter part 520, but the third diameter part 530*b* has an outer diameter that is greater than the second outer diameter. The container body 500*b* illustrated in FIG. 2(*b*) can be fabricated, for example, by blow molding. By using blow molding, it is possible for the container body 500*b* to include portions below the body rim 510 that have an outer diameter greater than that of a first point (e.g., a portion having the first outer diameter) of the body rim 510.

As illustrated in FIG. 2, in a structure where the container body 500 includes a second diameter part 520 under the body rim 510, the body rim 510 can be shaped such that the outer diameter at a first point 512 (see FIGS. 5 to 7) is greater than the outer diameter at a second point 517 (see FIGS. 5 to 7) that is located lower than the first point 512. An airtight container 1000 according to an embodiment of the invention can include a container body 500*a*, 500*b* such as those illustrated in FIG. 2, but the invention is not limited thus. For example, even in cases where the first point 512 and second point 517 of the body rim 510 do not form a natural slope or curve but rather form an abrupt protrusion or ledge, it is still possible to implement a first point 512 having a larger outer diameter at a higher location and a second point 517 having a smaller outer diameter at a lower location.

Also, the body rim 510 of the container body 500 does not necessarily have to be shaped such that the outer diameter is decreased at the second point 517 compared to the first point 512, and it is possible to couple an airtight cover 100 according to an embodiment of the invention even in cases where the body rim 510 maintains the same outer diameter along a particular length.

Since it is possible to apply the airtight cover 100 even in cases where the body rim 510 maintains the same outer diameter, the airtight cover 100 according to an embodiment of the invention is applicable to a broad variety of container body 500 types. The container body 500 can be implemented such that its cross section is shaped as any one of a circle, a polygon, a combination of one or more circles and one or more polygons, and other various shapes, and even the body rim 510 can be shaped to have a circular or polygonal cross section.

Referring to FIG. 3, the airtight cover 100 can be separably coupled to the opening 550 of the container body 500 and can be configured to seal the interior of the container body 500 when the airtight cover 100 is in a coupled state with respect to the container body 500. The airtight cover 100 can include all or some of a cover body 110, a cover rim 120, an inner rib 130, a cover curb 140, a clearance recess 150, hook protrusions 160, hinge bases 170, fold parts 180, and a flap 190. The flap 190 can in turn include a support protrusion 200 and a contact part 210, and the contact part 210 can include a contact support surface 220.

The cover body 110 is a part that is configured to cover the opening 550 of the container body 500 and can generally take up the largest area of the airtight cover 100. The cover body 110 can be formed in a generally flat shape but can be implemented in any of a variety of shapes as necessary. In certain embodiments, a transparent material can be used for all or portions of the cover body 110. Since the cover body 110 serves to cover the opening 550 of the container body 500, the diameter of the cover body 110 can be greater than or equal to the outer diameter of the body rim 510.

The cover rim 120 can extend downward from the edge of the cover body 110. The inner rib 130 can extend downward with a smaller diameter at an inner side of the cover rim 120 and preferably can be formed such that the outer diameter of the inner rib 130 is smaller than the opening 550 of the container body 500. When the user couples the airtight cover 100 onto the container body 500, the body rim 510 of the container body 500 can be inserted between the cover rim 120 and the inner rib 130 of the airtight cover 100. The hook protrusions 160 can be formed on the cover rim 120 at required positions, and if holes 135 were to be formed in the inner rib 130 at corresponding positions, it would be possible to manufacture the airtight cover 100 by applying injection molding using slide core casts.

The cover curb 140 can be formed at the edge of the cover body 110 on the inner side of the cover rim 120. Together with the inner rib 130, the cover curb 140 can form a packing groove 145 in which to insert a packing (not shown). When the user couples the airtight cover 100 onto the container body 500, the packing (not shown) of the airtight cover 100 can press against the body rim 510 to seal the interior of the container body 500.

The clearance recess 150 corresponds to a recess formed in the cover rim 120. As illustrated in FIG. 3, a clearance recess 150 can be formed in the cover rim 120 at a position corresponding to the support protrusion 200 and the contact part 210, so that the cover rim 120 does not obstruct the movement of the contact part 210 when the user moves the flap 190.

The hook protrusions 160 can be formed extending inward from designated positions on a lower portion of the cover rim 120. In the example illustrated in FIG. 3, the lower surface of each hook protrusion 160 has a flat shape that lies in a horizontal plane parallel to the cover body 110, whereas the upper portion of each hook protrusion 160 forms an inclined surface 165. As described above with reference to FIG. 2, in cases where the body rim 510 is shaped such that a second point 517 located lower than a first point 512 has a decreased outer diameter, a hook protrusion 160 can be configured to contact the first point 512 and the second point 517 of the body rim 510, and in certain embodiments, the hook protrusion 160 can contact the first point 512 and the second point 517 by way of the inclined surface 165. In particular, in cases where the cross section of the body rim 510 has an inclined shape such that the outer diameter decreases from the first point 512 towards the second point 517, the inclined surface 165 of the hook protrusion 160 can be formed in a shape corresponding to the slope of the body rim 510.

Of course, the hook protrusion 160 does not necessarily have to have an inclined surface 165 in order to contact the first point 512 and the second point 517 located at a lower location on the body rim 510. The hook protrusion 160 can, for example, have a bent shape in form of an "L" shape. In certain embodiments, the hook protrusion 160 can simply extend in a horizontal direction to contact only the second point 517, which is located below the first point 512 on the body rim 510 and which has a decreased outer diameter. In cases where the body rim 510 maintains the same outer diameter in the vertical direction along a particular length as described above, the hook protrusion 160 can correspondingly be shaped to have the same inner diameter along a corresponding length.

Although FIG. 3 illustrates an example in which the airtight cover 100 includes one flap 190 and two hook protrusions 160, the numbers and positions of the flap 190 and hook protrusions 160 can be varied. In particular, in certain embodiments where the airtight cover 100 includes a multiple number of flaps 190, it is possible to omit the hook protrusions 160.

The hinge base 170 can extend outward from the cover body 110 and, more specifically, can extend outward from a designated position on the exterior surface formed by the cover body 110 and the cover rim 120. As illustrated in FIG. 3, in a preferred embodiment of the invention, the flap 190 can be connected to a pair of hinge bases 170, and the clearance recess 150 can be formed between the pair of hinge bases 170.

The fold parts 180 are the parts where the flap 190 is connected to the hinge bases 170, and the fold parts 180 can connect the flap 190 such that the flap 190 is rotatable in relation to the hinge base 170. To allow the flap 190 to rotate easily, the fold parts 180 can be formed along a straight line. In certain embodiments, the hinge bases 170 and the flap 190 can be molded from the same material into an integrated form, in which case the fold parts 180 can be formed in a thickness that allows the rotation of the flap 190 while providing a sufficient strength so as not to be easily damaged.

The flap 190 is the part that is connected by the fold parts 180, which may be formed on one side of the flap 190, to be rotatable in relation to the hinge bases 170. The support protrusion 200 can be provided on the same one side where the fold parts 180 are formed on the flap 190. When the flap 190 is in a lifted state as in FIG. 3, the airtight cover 100 can be separated from the container body 500, and when the flap 190 is rotated downward, the airtight cover 100 can be coupled to the container body 500, as the contact part 210 formed on the end portion of the support protrusion 200 is pressed against the container body 500.

As mentioned above, in certain embodiments that have not been illustrated, the airtight cover 100 can include a multiple number of flaps 190, and these can be connected to multiple hinge bases 170 formed at different positions. In cases where there are a sufficient number of flaps 190, it is possible for the airtight cover 100 not to include the hook protrusions 160.

The support protrusion 200 can extend in a direction heading towards the cover body 110 from the same one side of the flap 190 on which the fold parts 180 are provided. The contact part 210 can be provided on the end portion of the support protrusion 200. When the user rotates the flap 190 downward, the support protrusion 200 as well as the contact part 210 provided on the support protrusion 200 can move without being caught on the cover rim 120 by passing through the clearance recess 150.

The contact part 210 is the part that is formed on the end portion of the support protrusion 200 so as to contact the container body 500. In particular, a contact support surface 220 can be formed on the portion of the contact part 210 that contacts the container body 500 when the flap 190 is fully rotated downward. Incidentally, the contact part 210 can be sized such that the contact part 210 presses the body rim 510 during the course of the flap 190 being rotated downward. For example, while the flap 190 is being rotated about the hinge bases 170 downward, when the flap 190 reaches a particular angle, the end portion of the contact part 210 can contact the container body 500. While in this state, when a greater force is applied on the flap 190, at least one of the contact part 210, support protrusion 200, and fold parts 180 can be elastically deformed, thereby allowing the contact part 210 to move past the portion where the pressure contact occurs and consequently performing a locking procedure. This structure allows the airtight cover 100 to more securely achieve a locked state with respect to the container body 500.

The contact support surface 220 is a portion of the contact part 210 and can be configured to tightly press against the container body 500 when the flap 190 is rotated downward with respect to the hinge bases 170. In cases where the body rim 510 of the container body 500 has a larger outer diameter at a first point 512 and a smaller outer diameter at a second point 517 located lower than the first point 512 as described above, the contact support surface 220 can be configured to contact both the first point 512 and the second point 517 when the airtight cover 100 is in a coupled state with respect to the container body 500.

In certain embodiments, the flap 190, support protrusion 200, contact part 210, and contact support surface 220 can be molded from the same material into an integrated form, in which case the contact part 210 and the contact support surface 220 can be formed with a material and dimensions suitable for the locking procedure described above and for effectively maintaining a sealed state.

On the other hand, in certain embodiments, at least a portion of the support protrusion 200, contact part 210, and contact support surface 220 can be formed from a material that is different from that of the flap 190. For example, in an embodiment of the invention, the material used for the contact support surface 220 can have a lower elastic modulus than that of the material used for the flap 190. Reference to a material having a lower elastic modulus than that of a compared object is intended to mean that elastic deformation occurs more readily in said material than in the compared object. When the contact support surface 220 has a low elastic modulus, the contact support surface 220 can be more tightly pressed against the surface of the container body 500. For example, in cases where a plastic such as polypropylene (PP), etc., is used as the material for the flap 190, a rubber material having a lower elastic modulus such as silicone, etc., can be used for the contact support surface 220. As another example, the material used for the contact part 210 and/or support protrusion 200 can have a lower elastic modulus compared to the material used for the flap 190 in an embodiment of the invention. In such cases, the locking procedure described above can be performed more easily.

In certain embodiments, at least a portion of the support protrusion 200, contact part 210, and contact support surface 220 can be configured to be coupled onto the flap 190. This makes it possible to apply different materials for the above components and to replace any worn or damaged parts when necessary.

Figure 4:
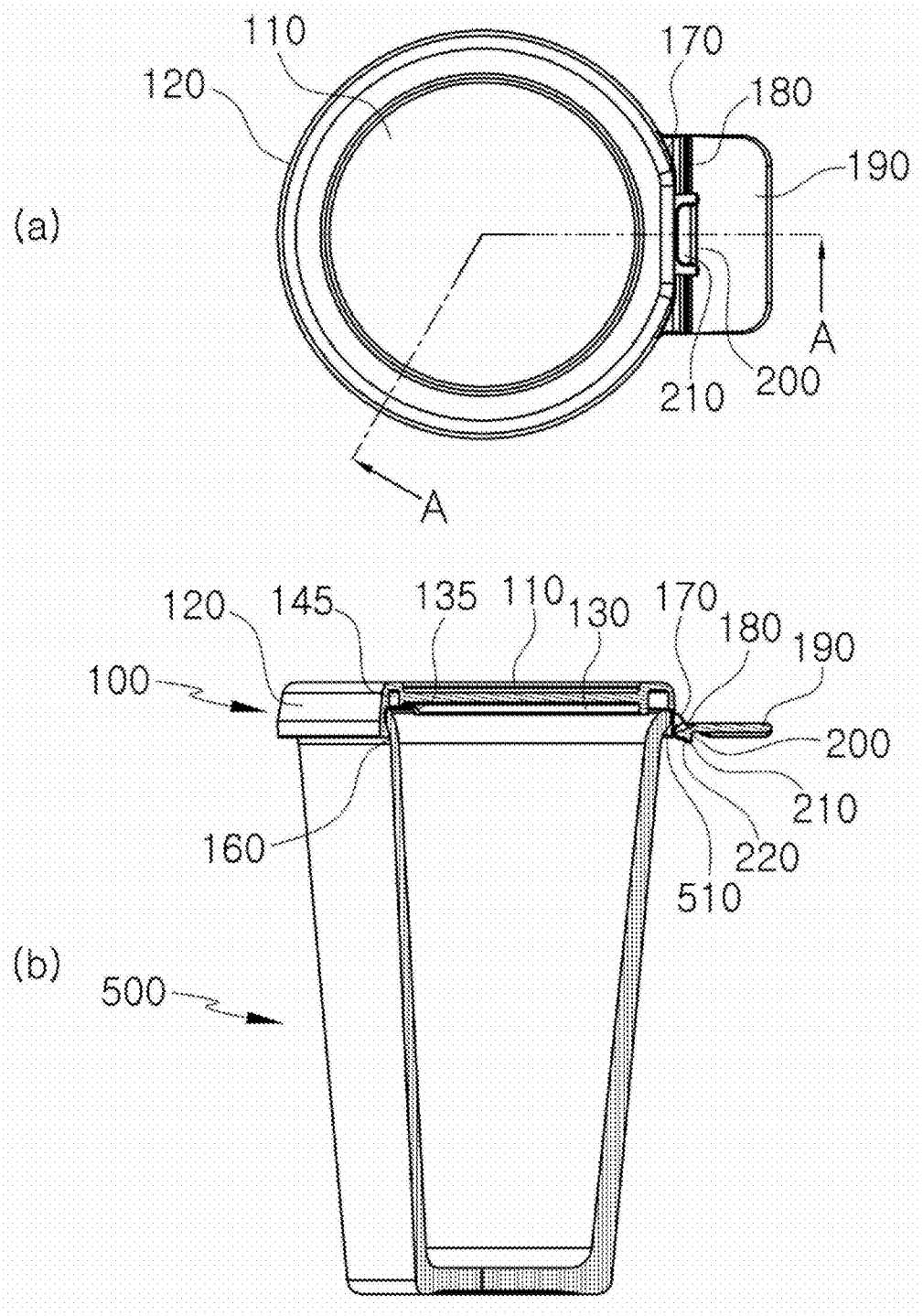
FIGS. 4 to 6 illustrate a process of sealing an airtight container according to an embodiment of the invention.
Figure 5:
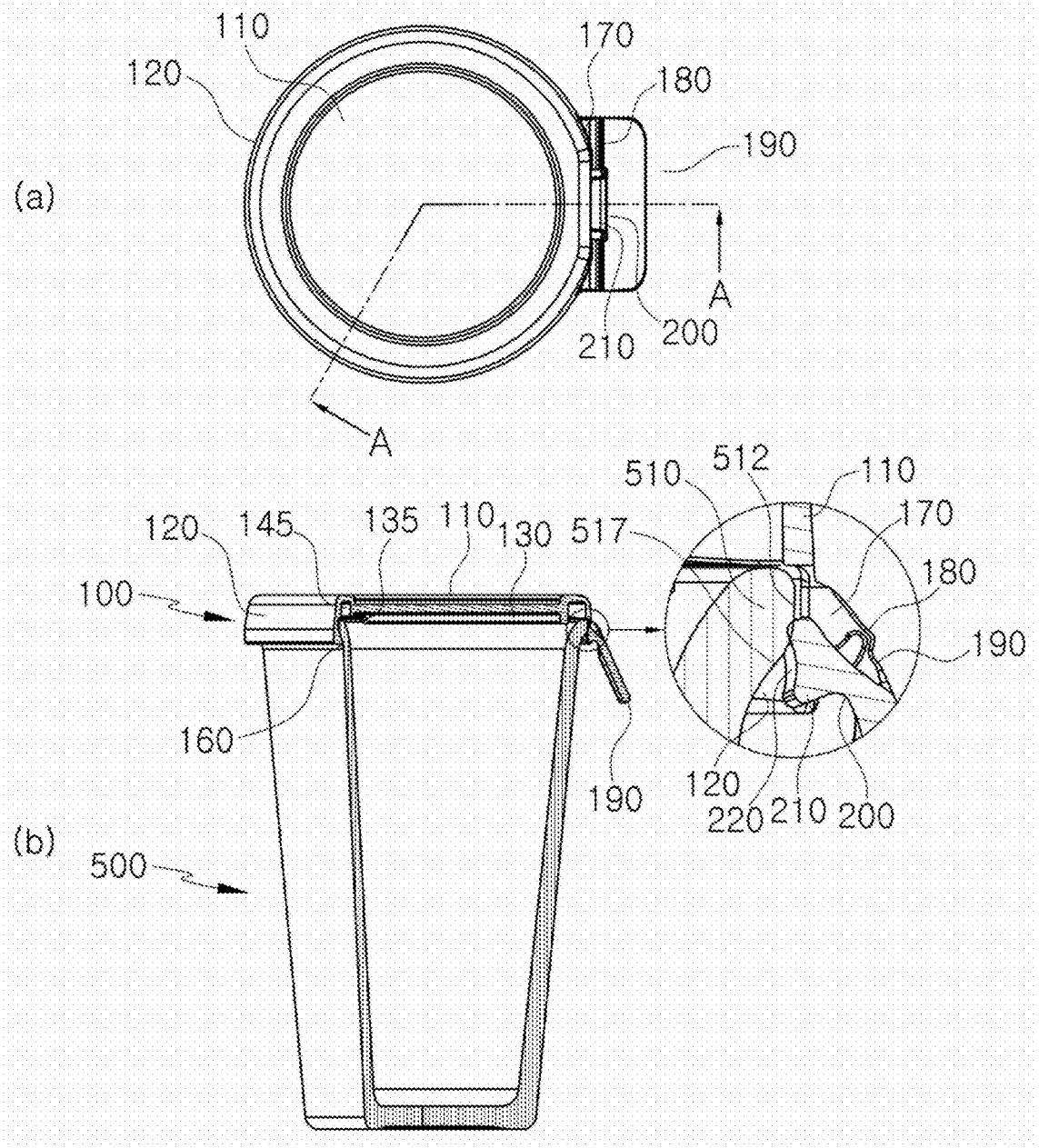
Figure 6:
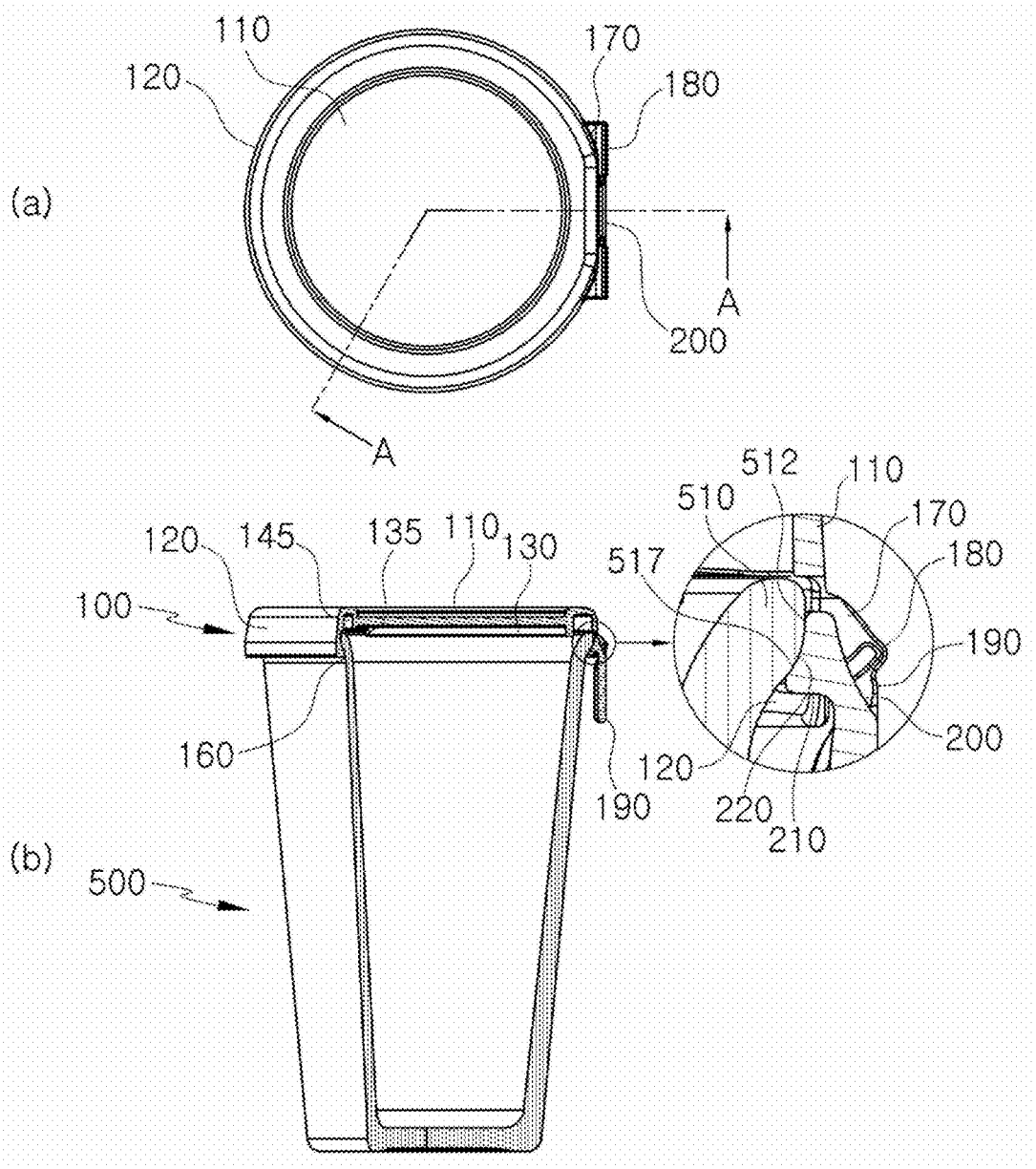
Figure 7:
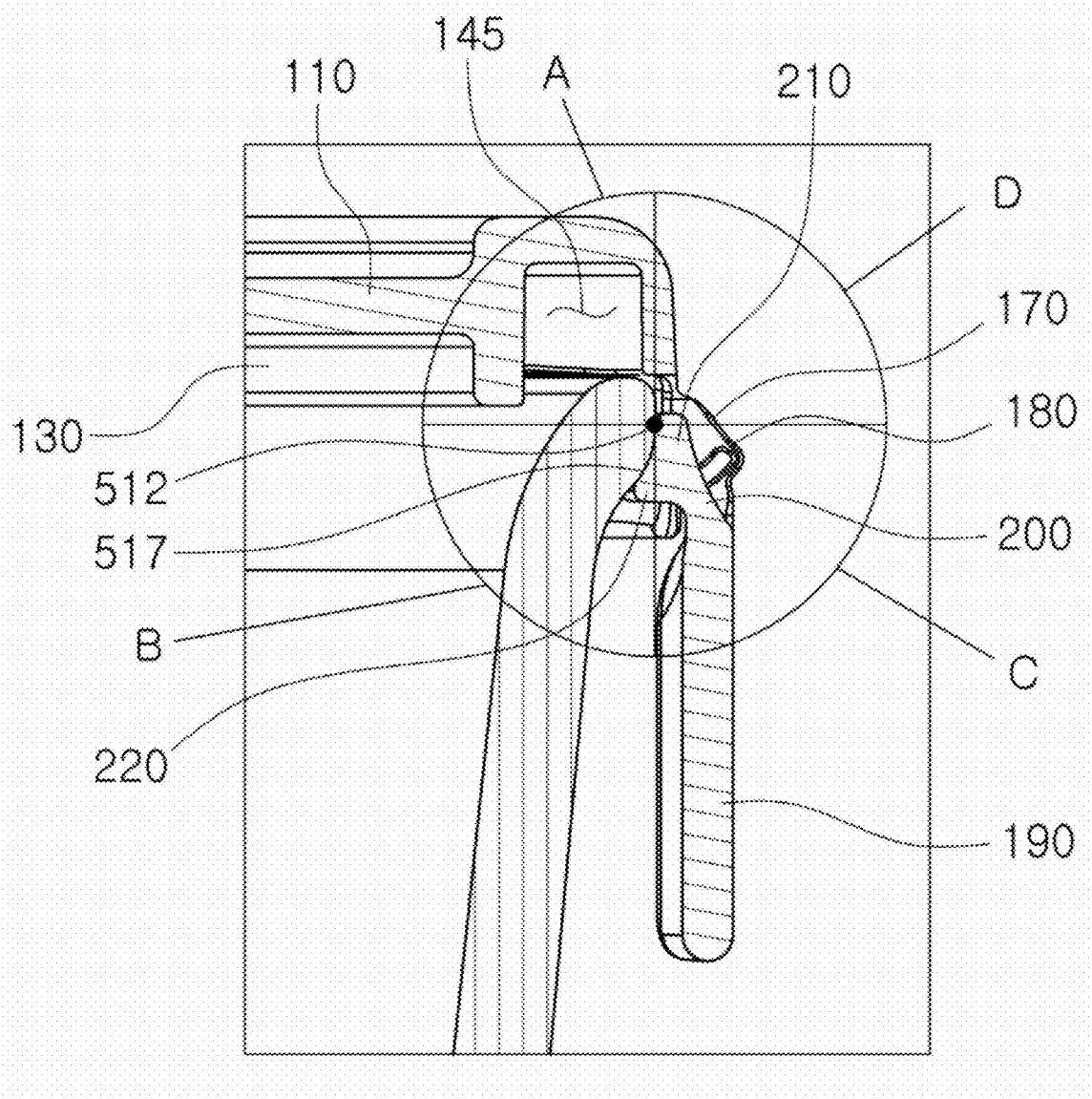
FIG. 7 is a magnified cross-sectional view illustrating the portions around the contact part in an airtight container according to an embodiment of the invention.

In the following, a process for sealing an airtight container 1000 according to an embodiment of the invention is described with reference to FIGS. 4 to 7. FIGS. 4 to 6 illustrate the process by which the airtight container 1000 according to an embodiment of the invention may be sealed, while FIG. 7 shows a magnified cross-sectional view illustrating a point of contact in an airtight container 1000 according to an embodiment of the invention. The present specification uses the term "reference line", where the reference line L refers to an imaginary line running from the center of the cover body 110 along a horizontal direction towards the center of the contact support surface 220. The cross sectional views provided in FIG. 4(*b*), FIG. 5(*b*), and FIG. 6(*b*) are taken along line A-A marked in FIG. 4(*a*), FIG. 5(*a*), and FIG. 6(*a*), where a part of line A-A is parallel to the reference line L.

First, the structure of the airtight cover 100 can prevent the inner surface of the cover body 110 from touching the surface of a table, etc., when the airtight cover 100 is in a separated state from the container body 500. Since the cover rim 120 extends down from the cover body 110, the cover rim 120 can first contact the surface of a table, etc., and can enable the cover body 110 to maintain a horizontal orientation. This can prevent the inner surface of the cover body 110 from being contaminated by outside substances and conversely can prevent the surface of the table, etc., from being contaminated by any content of the airtight container 1000 that may have adhered to the inner surface of the cover body 110.

Referring to FIG. 4, when the user closes the airtight container 1000, the user can place the airtight cover 100 on the container body 500, and the body rim 510 may be positioned between the cover rim 120 and the inner rib 130. Here, from the perspective of the flap 190, the airtight cover 100 can be placed slightly to the rear compared to the container body 500 (towards the left of the drawing in FIG. 4(*b*)).

In the state illustrated in FIG. 4, the hook protrusions 160 do not yet fully contact the body rim 510. Incidentally, the positions on the airtight cover 100 where the hook protrusions 160 are formed may preferably be within a range of angles exceeding 90 degrees to the left and right from the reference line L (i.e., the 180-degree range on the opposite side of the flap 190). Even in this state where the hook protrusions 160 do not yet contact the body rim 510, the airtight cover 100 can maintain a stable posture, since the inner rib 130 is formed slightly smaller than the opening 550 of the container body 500.

FIG. 5 illustrates the state midway through the user rotating the flap 190 downward. In FIG. 5 also, it is possible for the hook protrusions 160 to not yet tightly press against the body rim 510. However, as the flap 190 is rotated downward, the contact part 210 formed on the end portion of the support protrusion 200 may contact the surface of the container body 500.

The magnified view in FIG. 5(*b*) shows the body rim 510 on which the first point 512 is formed at a higher location with a greater outer diameter and the second point 517 is formed at a lower location with a smaller outer diameter. The first point 512 and the second point 517 can be connected naturally, so that the cross section of the body rim 510 may form a slope or a curve.

The magnified view in FIG. 5(*b*) also depicts the upper portion of the contact part 210 as overlapping a portion of the body rim 510, and this represents the position of the contact part 210 in relation to the body rim 510 if no elastic deformation were to occur in any part of the airtight cover 100. That is, if there were no elastic deformation in the airtight cover 100, the contact part 210 would be caught on the body rim 510, so that the flap 190 would not be able to rotate downward completely.

However, as already described above, at least a portion of the airtight cover 100 can be formed from a material capable of elastic deformation, and the contact part 210 can pass over the portion at which there is pressure contact with the body rim 510, as elastic deformation occurs in at least one of the contact part 210, support protrusion 200, and fold parts 180. More specifically, when the flap 190 reaches a particular angle during the process of the user rotating the flap 190 downward, the end portion of the contact part 210 can contact the container body 500, for example on the second point 517 marked in FIG. 5(*b*). While in this state, if the user applies a greater force on the flap 190, the contact part 210 may press against the body rim 510, and this pressing force can cause at least one of the contact part 210, support protrusion 200, and fold parts 180 to be elastically deformed, at which the contact part 210 can move past the portion where the pressure contact occurs.

FIG. 6 illustrates the state after the contact part 210 has moved past the portion where pressure occurs and the flap 190 has been rotated 90 degrees. As described above, while the upper end portion of the contact part 210 is in contact with the surface of the body rim 510, the user can continue to press down on the flap 190 and cause the contact part 210 to pass over the point of pressure contact with respect to the body rim 510. Since a clearance recess 150 is formed in the cover rim 120 of the airtight cover 100 at a position corresponding to the support protrusion 200 of the flap 190, the contact support surface 220 of the contact part 210 can pass through the clearance recess 150 and tightly press against the body rim 510.

In particular, while in this state, the body rim 510 pressing against the contact support surface 220 can cause the cover body 110 to be pulled in the direction of the flap 190 along the reference line, and as a result, the hook protrusions 160 can tightly contact the body rim 510 as shown in FIG. 6(*b*). As described above, the hook protrusions 160 can press against only the first point 512, press against only the second point 517, or press against both the first point 512 and the second point 517 of the body rim 510. As the cover body 110 is pulled in the direction of the flap 190, the packing (not shown) inserted in the packing groove 145 can be aligned with the top of the body rim 510, so that the opening 550 may be completely sealed.

In the following, the principles by which an airtight cover 100 tightly seals the container body 500 according to an embodiment of the invention are described in further detail with reference to FIG. 7. FIG. 7 is a magnified cross-sectional view illustrating the portions around the contact part 210 in an airtight container according to an embodiment of the invention.

FIG. 7 illustrates an example in which the contact support surface 220 of the contact part 210 contacts the first point 512 and the second point 517 of the body rim 510, and four quadrants A, B, C, D are defined centering around the first point 512. The four quadrants A, B, C, D are marked to describe possible positions of the fold part 180 with respect to the point of contact between the contact support surface 220 and the body rim 510, where quadrant A is the inner upper quadrant, quadrant B is the inner lower quadrant, quadrant C is the outer lower quadrant, and quadrant D is the outer upper quadrant. In the cross-sectional view of FIG. 7, the horizontal direction is a direction parallel to the reference line L. The reference line L is a line running along a horizontal direction from the center of the cover body 110 towards the center of the contact support surface 220, as already described above.

In the structure illustrated in FIG. 7, the body rim 510 applies a normal force in an outward direction onto the contact support surface 220 of the contact part 210 from the first point 512, so that the first point 512 serves as the pressure point, and the fold part 180 is at an outer lower location in relation to the pressure point. In other words, with respect to the first point 512 from which the normal force is applied in an outward direction, the fold part 180 is positioned at a lower location and is positioned at an outward location along the direction of the reference line L. That is, the fold part 180 is in quadrant C.

With respect to the reference line L, which runs from the center of the cover body 110 towards the center of the contact support surface 220 along a horizontal direction, the fold part 180 corresponds to the axis about which the parts connected to the flap 190, including the contact support surface 220 and the contact part 210, rotate in relation to the hinge base 170.

Therefore, if the fold part 180 is present in quadrant C, then the normal force applied by the body rim 510 due to the contact between the contact support surface 220 and the body rim 510 would be applied from above the fold part 180, which serves as the axis of rotation, and as a result would apply a force that rotates the flap 190 downward about the fold part 180. Looking at the composition of FIG. 7 as an example, the normal force applied in an outward direction onto the contact support surface 220 at the first point 512, which serves as the pressure point, would cause the flap 190, which is connected to the contact part 210 and the support protrusion 200, to rotate in a clockwise direction about the fold part 180. Since a rotation of the flap 190 in the clockwise direction in FIG. 7 is an action that locks the airtight cover 100, the airtight cover 100 can maintain a coupled state with respect to the opening 550 of the container body 500.

In the state illustrated in FIG. 7, the body rim 510 applies the normal force from the first point 512 onto the contact support surface 220 in an outward direction to thereby pull the airtight cover 100 in relation to the container body 500 in the direction of the reference line L. At positions other than the position of the illustrated flap 190, there can be another flap 190 provided or hook protrusions 160 provided, and these can similarly tightly press against the body rim 510. Consequently, the airtight cover 100 can remain secured to the container body 500 with respect to the horizontal direction.

In cases where the body rim 510 includes a second point 517 that has a smaller outer diameter at a lower location compared to the first point 512, the contact support surface 220 can contact the second point 517 as well. In such cases, since the contact support surface 220 contacts the second point 517, i.e., the portion below the first point 512 where the outer diameter is decreased, the airtight cover 100 can maintain a secured state with respect to the vertical direction also. That is, if an upward force were to be applied on the airtight cover 100 while the airtight cover 100 is in a locked state, the contact support surface 220 can be caught on the portion above the second point 517 to prevent the airtight cover 100 from being opened.

As described above, however, having the body rim 510 apply the normal force on the contact support surface 220 in an outward direction at the pressure point is sufficient for maintaining the locked state of the airtight cover 100. Therefore, the body rim 510 does not necessarily have to be shaped to include a second point 517 having a decreased outer diameter compared to a first point 512, and it is possible to couple an airtight cover 100 according to an embodiment of the invention even in cases where the body rim 510 maintains the same outer diameter along the vertical direction over a particular length. In such cases, the friction between the contact support surface 220 and the body rim 510 can serve to secure the airtight cover 100 with respect to the vertical direction.

Next, a description is provided for cases involving the fold part 180 located in other quadrants, although these cases are not illustrated in the drawings. In certain embodiments, the fold part 180 can be located in quadrant B. Since the quadrants A, B, C, D are divided using the first point 512 as the center point within a vertical plane that includes the reference line L, cases in which the fold part 180 is located in quadrant B can include, for example, a case where the cover body 110 has a circular shape and the hinge bases 170 and the fold parts 180 are positioned on the circumference away from the contact part 210 (i.e., a case where an imaginary line extending from the center of the cover body 110 to a fold part 180 forms a large angle with respect to the reference line L). Of course, it is also possible to have the fold part 180 located in quadrant B in a structure in which the cover body 110 and the body rim 510 include portions that are recessed inward and the fold parts 180 are formed in the recessed portions.

In cases where the fold part 180 is located in quadrant B also, the normal force applied by the body rim 510 due to the contact between the contact support surface 220 and the body rim 510 would be applied from above the fold part 180, which serves as the axis of rotation, and as a result can apply a force that rotates the flap 190 downward about the fold part 180. The normal force applied at the first point 512 onto contact support surface 220 in the outward direction can cause the flap 190, which is connected to the contact part 210 and the support protrusion 200, to rotate downward about the fold part 180, thus allowing the airtight cover 100 to maintain a coupled state with respect to the opening 550 of the container body 500.

Although not illustrated in the drawings, a description is now provided for cases in which the body rim 510 applies a normal force onto the contact support surface 220 of the contact part 210 in an outward and downward direction from the second point 517, such that the second point 517 serves as the pressure point, and the fold part 180 is located further inward compared to the pressure point along the direction of the reference line L. These cases would correspond to the fold part 180 being located in quadrant A or quadrant B for quadrants centering around the second point 517.

If the fold part 180 is located in quadrant B with respect to the second point 517, the outward component of the normal force applied at the pressure point of the second point 517 onto the contact support surface 220 would cause the flap 190 to rotate downward and can thus allow the airtight cover 100 to maintain a coupled state.

If the fold part 180 is located in quadrant A with respect to the second point 517, the downward component of the normal force applied at the pressure point of the second point 517 onto the contact support surface 220 would pull the cover body 110 in an outward and downward direction. Since the normal force at the pressure point causes the contact part 210 and the cover body 110 to pull each other while the body rim 510 is present between the contact support surface 220 and the cover body 110, the airtight cover 100 can maintain a secured state with respect to both the horizontal direction and the vertical direction. Of course, in cases where the fold part 180 is located in quadrant A or quadrant B with respect to the first point 512 or the second point 517, the normal force at the pressure point can partially be applied in a direction that rotates the flap 190 upward. Therefore, in cases where the fold part 180 is located in quadrant A or quadrant B, the sizes, shapes, and positions of the hinge base 170, flap 190, support protrusion 200, contact part 210, and contact support surface 220 can be designed such that the component of the normal force acting towards closing the airtight cover 100 is greater than the component of the normal force acting towards opening the airtight cover 100.

An airtight cover 100 and an airtight container 1000 including the airtight cover 100 according to an embodiment of the invention can seal a container body 500 even if there are no protrusions formed on the container body 500, and this feature can provide a great variety of advantages.

First, the fact that the container body 500 does not require protrusions means that the airtight cover 100 can be coupled to existing container bodies 500 of numerous types and that the utility of the airtight cover 100 can be increased greatly. Also, since there are no protrusions formed on the container body 500, it becomes more convenient to carry and store the container body 500, and it becomes more convenient to clean the container body 500, so that the container body 500 can be kept at a high level of cleanliness more easily. In addition, it becomes more easier to open the airtight container 1000, since there is no risk of the airtight cover 100 bumping into or getting caught on the protrusion of the container body 500 when the airtight cover 100 is being opened.

As regards the manufacturing aspect, the container body 500 does not require protrusions and therefore can be manufactured in a simpler shape. Since there are no portions such as protrusions or hooks, etc., that require precision processing, the allowable range of tolerances can be greatly increased. An airtight cover 100 according to an embodiment of the invention can be manufactured by the relatively simple method of injection molding.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. An airtight container comprising a container body and an airtight cover, the container having an opening, the airtight cover configured to be separably coupled to the opening of the container body, wherein the airtight cover comprises:

a cover body configured to cover the opening;

a hinge base extending outward from the cover body;

a flap rotatably connected to the hinge base by a fold part formed on one side thereof; and a support protrusion extending from the one side of the flap in a direction heading towards the cover body, the support protrusion having a contact part formed on an end portion thereof, the contact part configured to contact the container body, wherein rotating the flap downward with respect to the hinge base causes a contact support surface of the contact part to press against the container body and allows the airtight cover to be coupled to the container body, and wherein, for a reference line defined as an imaginary line running from a center of the cover body along a horizontal direction towards a center of the contact support surface and for a pressure point defined as a point at which the container body applies a normal force in an outward direction onto the contact support surface, the fold part is located under the pressure point and is located further outward compared to the pressure point along the reference line when the airtight cover is in a coupled state with respect to the container body.

2. The airtight container of claim 1, wherein the container body comprises a body rim, the body rim formed such that an outer diameter at a first point is greater than an outer diameter at a second point located lower than the first point, and the contact support surface contacts the first point and the second point when the airtight cover is in a coupled state with respect to the container body.

3. The airtight container of claim 2, wherein an end portion of the contact part contacts the container body when the flap reaches a particular angle while the flap is being rotated downward with respect to the hinge base, and the contact part passes over when a greater force is applied on the flap as at least one of the contact part, the support protrusion, and the fold part undergoes elastic deformation.

4. The airtight container of claim 2, wherein the container body is fabricated by blow molding such that a portion of the container body under the body rim has an outer diameter greater than that of the first point.

5. The airtight container of claim 1, wherein the airtight cover further comprises a cover rim extending downward from an edge of the cover body, and the hinge base extends outward from a designated position on an exterior surface formed by the cover body and the cover rim.

6. The airtight container of claim 5, wherein the flap is connected to a pair of hinge bases by a pair of fold parts, the support protrusion extends in the direction heading towards the cover body from a position between the pair of fold parts, and a clearance recess is formed in the cover rim at a position corresponding to a space between the pair of hinge bases such that the support protrusion passes through the clearance recess when the flap is rotated.

7. The airtight container of claim 5, wherein the airtight cover further comprises a hook protrusion extending inward from a lower portion of the cover rim.

8. The airtight container of claim 7, wherein the container body comprises a body rim, the body rim formed such that an outer diameter at a first point is greater than an outer diameter at a second point located lower than the first point, and the hook protrusion includes an inclined surface configured to contact the first point and the second point when the airtight cover is in a coupled state with respect to the container body.

9. The airtight container of claim 1, wherein the container body has a cross section corresponding to any one of a circle, a polygon, and a combination of one or more circles and one or more polygons.

10. The airtight container of claim 1, wherein the airtight cover comprises a plurality of flaps.

11. The airtight container of claim 1, wherein at least a portion of the contact support surface, the contact part, and the support protrusion is replaceably coupled with the flap.

12. The airtight container of claim 11, wherein at least a portion of the contact support surface, the contact part, and the support protrusion has a lower elastic modulus than that of the flap.

13. An airtight cover separably coupled to an opening of a container body, the airtight cover comprising:

a cover body configured to cover the opening;

a hinge base extending outward from the cover body;

a flap rotatably connected to the hinge base by a fold part formed on one side thereof; and a support protrusion extending from the one side of the flap in a direction heading towards the cover body, the support protrusion having a contact part formed on an end portion thereof, the contact part configured to contact the container body, wherein rotating the flap downward with respect to the hinge base causes a contact support surface of the contact part to press against the container body and allows the airtight cover to be coupled to the container body, and wherein, for a reference line defined as an imaginary line running from a center of the cover body along a horizontal direction towards a center of the contact support surface and for a pressure point defined as a point at which the container body applies a normal force in an outward direction onto the contact support surface, the fold part is located under the pressure point and is located further outward compared to the pressure point along the reference line when the airtight cover is in a coupled state with respect to the container body.

* * * * *